US009682793B2

(12) United States Patent
Magnusson et al.

(10) Patent No.: US 9,682,793 B2
(45) Date of Patent: Jun. 20, 2017

(54) PRODUCT PACKAGE WITH PRODUCT MECHANISM

(71) Applicant: Nokia Corporation, Espoo (FI)

(72) Inventors: Birgir Magnusson, Sipoo (FI); Sami Saila, Halikko (FI)

(73) Assignee: Nokia Technologies Oy, Espoo (FI)

( * ) Notice: Subject to any disclaimer, the term of this patent is extended or adjusted under 35 U.S.C. 154(b) by 643 days.

(21) Appl. No.: 14/159,977

(22) Filed: Jan. 21, 2014

(65) Prior Publication Data

US 2015/0203242 A1 Jul. 23, 2015

(51) Int. Cl.
*B65D 5/38* (2006.01)
*B65D 5/52* (2006.01)

(52) U.S. Cl.
CPC ..... *B65D 5/38* (2013.01); *B65D 5/5213* (2013.01)

(58) Field of Classification Search
CPC . A45C 11/00; A45C 11/16; A47F 7/03; B65B 69/00; B65D 5/16; B65D 5/38; B65D 5/44; B65D 5/5021; B65D 5/52; B65D 5/5213; B65D 5/528
USPC ..... 206/732, 738, 751–756, 759–762, 804, 206/817; 220/500
See application file for complete search history.

(56) References Cited

U.S. PATENT DOCUMENTS

| | | | | | |
|---|---|---|---|---|---|
| 244,519 | A * | 7/1881 | Back | B65D 5/16 | 206/738 |
| 1,005,968 | A * | 10/1911 | Hauser | A45C 11/16 | 206/751 |
| 1,892,111 | A * | 12/1932 | Molins | B65D 5/72 | 206/804 |
| 2,616,558 | A * | 11/1952 | Kay, Jr. | A24F 9/14 | 206/752 |
| 2,657,793 | A | 11/1953 | Goldshine | | |
| 2,675,911 | A * | 4/1954 | Thurston | A47F 7/03 | 206/754 |
| 2,951,583 | A * | 9/1960 | Sanford | B65D 5/5021 | 206/754 |
| 3,900,100 | A * | 8/1975 | Girman | B65D 5/5021 | 206/755 |

FOREIGN PATENT DOCUMENTS

| | | | | |
|---|---|---|---|---|
| GB | EP 0098107 A2 * | 1/1984 | | B65D 5/5213 |
| WO | WO 9824696 | 6/1998 | | |
| WO | WO 2007083151 | 7/2007 | | |

OTHER PUBLICATIONS

"The Cabrio", Burgopak Studio 2013, Downloaded from http://www.burgopakstudio.com/products/ on Dec. 29, 2013, 1 page.

(Continued)

*Primary Examiner* — Bryon Gehman
(74) *Attorney, Agent, or Firm* — Locke Lord LLP

(57) ABSTRACT

A product package including: an inner part and an outer part, the outer part being configured to move in relation to the inner part between an open configuration and a closed configuration; wherein the inner part comprises a compartment configured to store a product; and wherein the package further comprises an opening mechanism configured to automatically pull the product out of the compartment of the inner part upon opening the package.

18 Claims, 8 Drawing Sheets

(56) References Cited

OTHER PUBLICATIONS

"The Left & Right", Burgopak Studio 2013, Downloaded from http://www.burgopakstudio.com/products/ on Dec. 29, 2013, 1 page.
"The Revealer", Burgopak Studio 2013, Downloaded from http://www.burgopakstudio.com/products/ on Dec. 29, 2013, 1 page.
"The Telescopic", Burgopak Studio 2013, Downloaded from http://www.burgopakstudio.com/products/ on Dec. 29, 2013, 1 page.
International Search Report for International Application No. PCT/FI2014/050966—Date of Completion of Search: Mar. 30, 2015, 3 pages.
PCT Written Opinion of the International Searching Authority for International Application No. PCT/FI2014/050966—Date of Completion of Opinion: Mar. 30, 2015, 5 pages.

* cited by examiner

PRODUCT PACKAGE WITH PRODUCT MECHANISM

TECHNICAL FIELD

The present invention generally relates to a product package such as a sales package for a consumer device or consumer product.

BACKGROUND ART

Consumer devices and products are often sold and/or stored in sales packages, such as boxes or other suitable containers. Different package types comprise different opening mechanisms.

SUMMARY

According to a first example aspect of the invention there is provided a product package comprising an inner part and an outer part, the outer part being configured to move in relation to the inner part between an open configuration and a closed configuration; wherein the inner part comprises a compartment configured to store a product; and wherein the package further comprises an opening mechanism configured to automatically pull the product out of the compartment of the inner part upon opening the package.

In an example embodiment, upon opening the package, a movement of the outer part towards the open configuration is configured to cause the opening mechanism to automatically pull the product out of the compartment of the inner part. In an example embodiment, the movement of the outer part is a sideways movement in relation to the package.

In an example embodiment, the opening mechanism is configured to pull the product out of the compartment of the inner part to a surface of the package upon opening the package.

In an example embodiment, the opening mechanism is configured to pull the product out of the compartment of the inner part to a surface of the package and to slide the product along the surface of the package upon opening the package.

In an example embodiment, the opening mechanism is configured to pull the product out of the compartment of the inner part in vertical direction and to slide the product along a surface of the product package in horizontal direction upon opening the package.

In an example embodiment, the opening mechanism comprises at least one elongated opening member.

In an example embodiment, the elongated opening member is loosely engaged with the outer part so that the outer part is allowed to slide in relation to the elongated opening member and wherein one end of the elongated opening member is connected to the inner part and another end of the elongated opening member is operatively connected to the product.

In an example embodiment, the elongated opening member is connected to the product through a packaging component configured to receive the product.

In an example embodiment, the packaging component comprises at least one of the following: a cradle, a box, an insert, a protective plastic bag, a protective film, and a tray.

In an example embodiment, a product configured to be stored in the package has a width W and the elongated opening member is engaged with the outer part at a position whose distance from an outer edge of the outer part is ½ W. In an example embodiment, a product configured to be stored in the package has a width W and an operative length of the elongated opening member is two times the width W or greater than two times the width W or at least two times the width W.

In an example embodiment, the product package further comprises a closing mechanism configured to automatically push the product into the compartment of the inner part upon closing the package.

In an example embodiment, upon closing the package, a movement of the outer part towards the closed configuration is configured to cause the closing mechanism to automatically push the product into the compartment of the inner part.

In an example embodiment, the closing mechanism comprises at least one elongated closing member.

In an example embodiment, one end of the elongated closing member is connected to the inner part and another end of the elongated closing member is operatively connected to the product.

According to a second example aspect of the invention there is provided a method comprising allowing a user to open a product package that comprises an inner part and an outer part configured to move in relation to each other between an open configuration and a closed configuration, wherein the inner part comprises a compartment configured to store a product; and upon the user opening the product package, automatically pulling the product out of the compartment of the inner part.

In an example embodiment, the method further comprises causing the automatic pulling of the product by a movement of the outer part towards the open configuration.

In an example embodiment, the method further comprises pulling the product out of the compartment of the inner part to a surface of the package upon the user opening the package.

In an example embodiment, the method further comprises automatically pushing the product into the compartment of the inner part upon the user closing the package.

In an example embodiment, the method further comprises causing the automatic pushing of the product by a movement of the outer part towards the closed configuration.

In an example embodiment, the method further comprises automatically pushing a product residing on a surface of the package into the compartment of the inner part upon the user closing the package.

Different non-binding example aspects and embodiments of the present invention have been illustrated in the foregoing. The above embodiments are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

The invention will be described, by way of example only, with reference to the accompanying drawings, in which.

DETAILED DESCRIPTION

Figure 1:
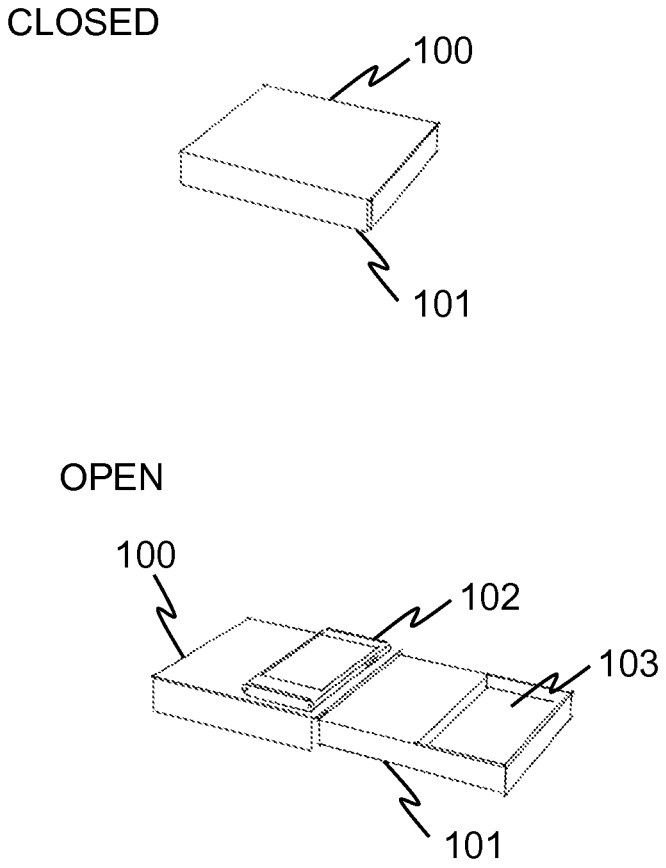
FIG. 1 shows schematic views of a package according to an example embodiment of the invention in a closed configuration and in an open configuration.

Some example embodiments of the present invention and potential advantages are understood by referring to FIGS. 1 through 9 of the drawings.

In an example embodiment there is provided a package that is configured to automatically pull or shift a product out of the package upon opening the package and to push or shift the product back inside the package upon closing the package. That is, when the package is opened by a user the product inside the package is pulled out of the package to a position in which the product is fully exposed without the user having to touch the product. In this way a magical/impressive opening experience is provided to a user opening the package.

In an example embodiment the product package comprises an outer part that is configured to move between open and closed configurations and a movement of the outer part is configured to cause automatic movement of the product out of the package or into the package.

In an example embodiment the package is configured to, upon a user opening the package, to automatically pull the product to a surface (e.g. the top surface) of the package. Upon a user closing the package, the package is configured to push the product back inside the package. In an example embodiment the product is configured to be pulled to a side surface of the package.

In an example embodiment the package is configured to, upon a user opening the package, to automatically pull the product to a surface (e.g. the top surface) of the package and to move the product sideways along the top surface of the package. Upon a user closing the package, the package is configured to first move the product sideways along the surface of the package and then to push the product back inside the package. In an example embodiment the package comprises an inner part and an outer part and the package is configured to slide the product over the top surface of the inner part and from thereon to a top surface of the outer part.

The package is for example a sales package or some other product package. In an example embodiment the package is suited for storing a mobile phone or some other handheld and/or electronic device or some other product. In an example embodiment the package is suited for storing a product having a rectangular or a candy bar like form. In an example embodiment the package is made of cardboard or plastic or some other suitable material.

In an example embodiment the package comprises an opening/closing mechanism configured to provide the desired movement of the product. In an example embodiment a movement of an outer package part causes the opening/closing mechanism to move the product. In an example embodiment the opening and/or closing mechanism comprises at least one elongated opening/closing member. In an example embodiment the opening/closing mechanism is made of flexible or easily sliding material. In an example embodiment such opening and/or closing mechanism is made of one or more films, thin sheets of material, ribbons, straps or threads or a combination thereof.

In an example embodiment such opening and/or closing mechanism comprises at least one of the following or a combination thereof: sliding films, paper ribbons, fabric ribbons and plastic ribbons or films.

In an example embodiment the opening/closing mechanism is configured to move the product stored in the package. In an example embodiment the opening/closing mechanism is configured to move a packaging unit configured to receive the product stored in the package. The packaging unit is configured to move together with the product. Such packaging unit is for example a cradle, a box, an insert, a protective plastic bag, a protective film, or a tray configured to receive the product. The opening/closing mechanism can move the packaging unit alone or the packaging unit with the product stored inside the packaging unit or the product alone.

FIG. 1 shows schematic views of a package according to an example embodiment of the invention in a closed configuration and in an open configuration.

The package comprises two parts 100 and 101 that are configured to move in relation to each other. In the closed configuration a top/outer part 100 covers a bottom/inner part 101. The inner part 101 comprises a compartment 103 configured to receive a product 102 that is to be stored in the package. In the closed configuration the package stores the product inside the package. In the open configuration, the outer part 100 has been moved to expose the inner part 101. In an example embodiment the outer part 100 has been moved sideways or in horizontal direction in relation to the inner part 101. In an example embodiment the movement of the parts 100 and 101 to the open configuration causes that the product 102 stored inside the package is automatically pulled out of the package and out of the inner part 101. In an example embodiment the product 102 is pulled to a surface of the package. In the shown example the product 102 is pulled to the top surface of the package. In an alternative embodiment the product 102 could be pulled to a side surface of the package.

Figure 2A:
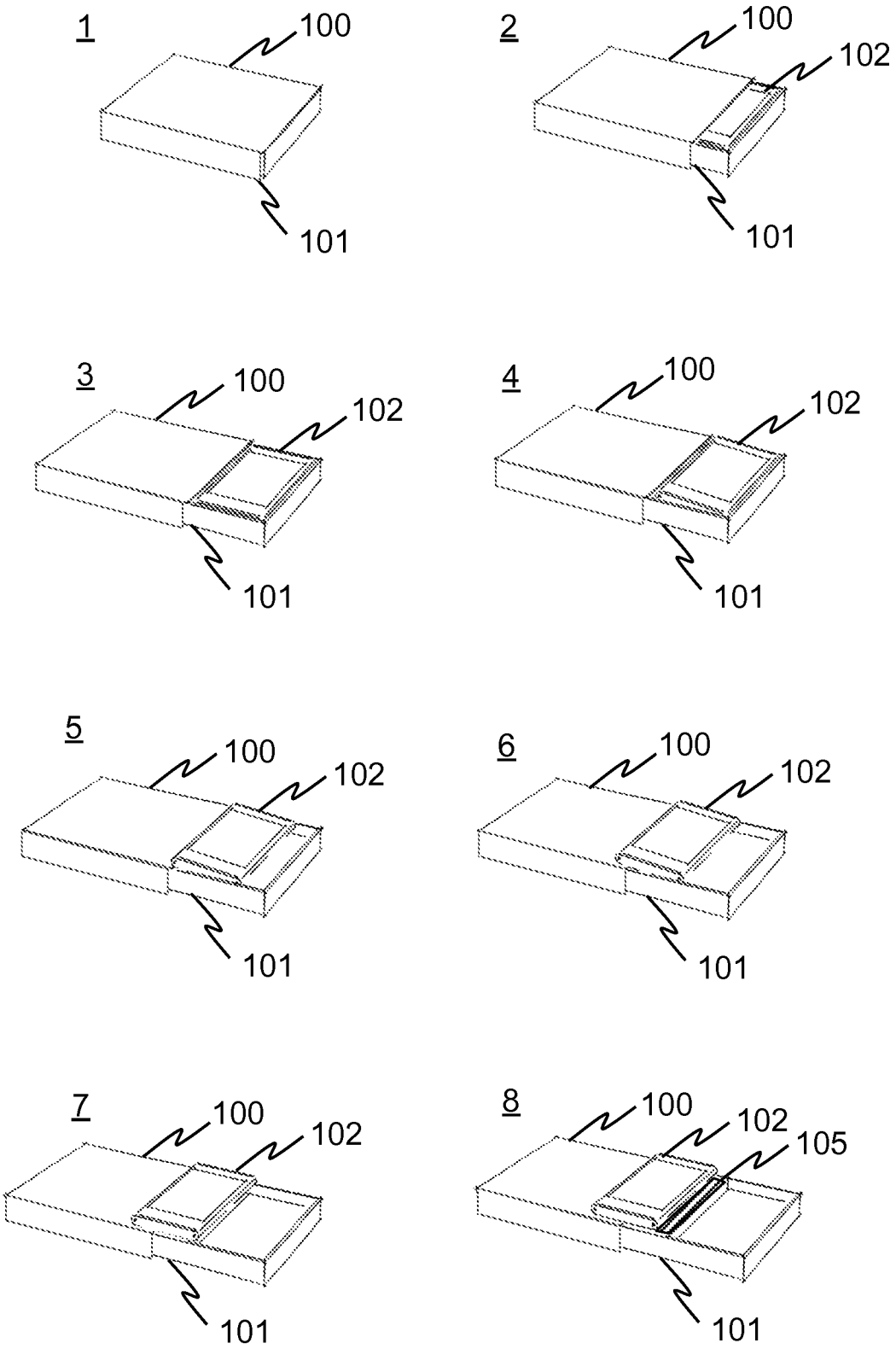
FIGS. 2A and 2B show a series of schematic views of a package according to an example embodiment of the invention in different stages between open and closed configurations.
Figure 2B:
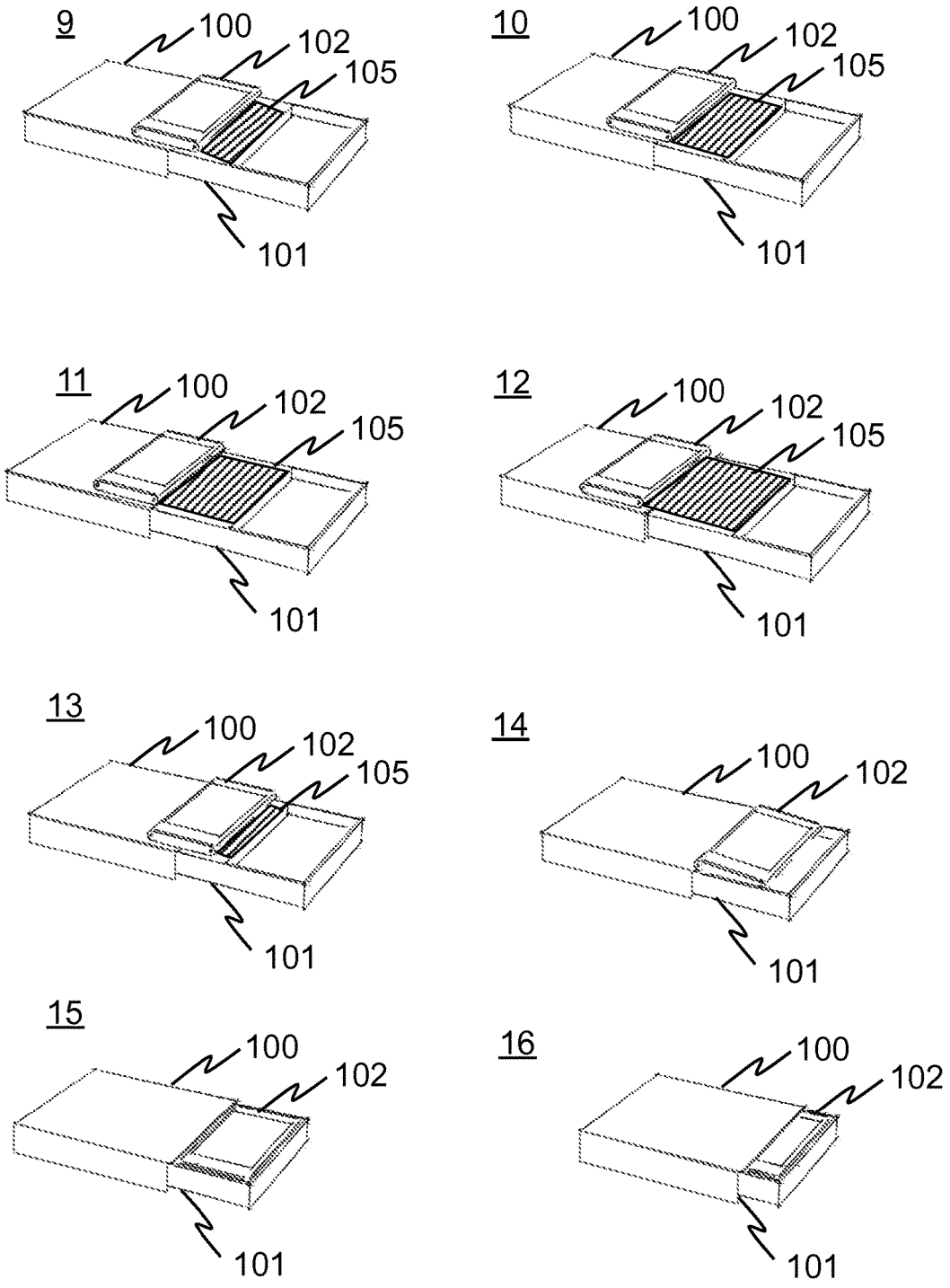

FIGS. 2A and 2B show a series of schematic views of a package according to an example embodiment of the invention in different stages between open and closed configurations.

The package comprises two parts 100 and 101 that are configured to move in relation to each other. In stage 1, the package is in closed configuration and an outer part 100 covers an inner part 101. In stages 2-12 the package is gradually opened and a product 102 inside the package becomes visible and the product 102 is pulled out of the package. In stages 13-16 the package is gradually closed and the product 102 is pushed back inside the package. In the shown example the package comprises a pull-out film 105 configured to pull the product 102 out of the package and a push-in film (not visible in the shown views) configured to push the product 102 back inside the package.

In stage 2, the outer part 100 is moved sideways and the product 102 is partially revealed. The pull-out film starts with plenty of slack and the push-in film has no slack. For the sake of definition it is mentioned that when the film has slack it is not tight.

In stage 3, the product 102 is fully visible. The pull-out film has no slack and the push-in film has no slack.

In stages 4-12, the product 102 is pulled out of the inner part 101. In an example embodiment the product 102 travels sideways along the surface of the package twice the distance compared with the outer part 100. The push-in film has no slack in these stages and is ready to operate in opposite direction. In stage 12, the package is in open configuration and the product 102 can be easily grabbed by a user.

In stages 13-16, the outer part 100 and the inner part 101 are gradually moved back towards the closed configuration. The pull-out film starts collecting slack. The push-in film has no slack and as the outer part is moved back to the closed configuration, the push-in film pushes the product 102 in so that the product 102 travels twice the distance that the outer part is being moved.

Further examples illustrating the operation of the pull-out and push-in films are discussed in connection with FIGS. 5 and 6. It is noted that shown examples comprise films 105 and 107 configured to move the product. Alternatively other elongated members can be used. Various examples have been discussed previously in this document. Furthermore it is noted that the films 105 and 107 can be rigid or elastic or partially elastic.

Figure 3A:
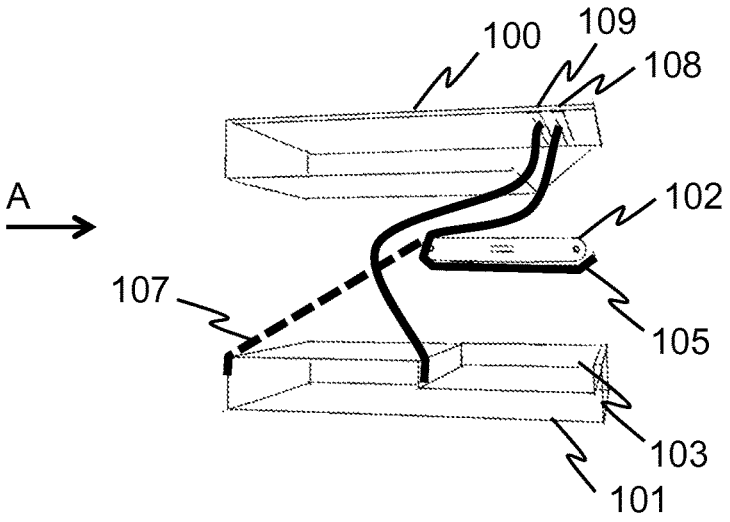
FIG. 3A shows a schematic view of a package according to an example embodiment of the invention.

FIG. 3A shows a schematic view of a package according to an example embodiment of the invention. The package comprises an outer part 100 and an inner part 101. The inner part 101 comprises a space or a compartment 103 configured to receive a product 102. The outer part 100, the inner part 101 and the product 102 are connected to each other with a pull-out film 105 and the inner part 101 and the product 102 are connected to each other with a push-in film 107. The pull-out film 105 is firmly connected to the inner part 101 and to one edge of the product 102. Additionally the pull-out film 105 runs through openings or holes 108 and 109 in the outer part 100. The pull-out film 105 is configured to slide through the openings 108 and 109. In this way, the pull-out film 105 is loosely engaged with the outer part 100 so that the outer part is allowed to move or slide in relation to the pull-out film 105. The push-in film 107 is connected to the inner part 101 and to one edge of the product 102. In an example embodiment the pull-out film 105 and the push-in film 107 are connected to opposite edges of the product 102. In the example of FIG. 3A, one can see that the top surface of the outer part 100 is folded and has two layers. In an example embodiment the outer layer has no holes while the inner layer has holes 108 and 109. In this way the film 105 is not visible on the surface of the package.

It is to be noted that FIG. 3A shows the films 105 and 107 connected to the product 102. An operative connection between the films and the package suffices, though. That is, the films are not necessarily directly connected to the product, but the connection may be through some other component. In an alternative example the films are be connected to a suitable packaging unit configured to receive the product and configured to move with the product. In this way, there is no need to attach the films to the product. Some alternative packaging units and alternatives to the films of this example have been previously discussed in this document.

Figure 3B:
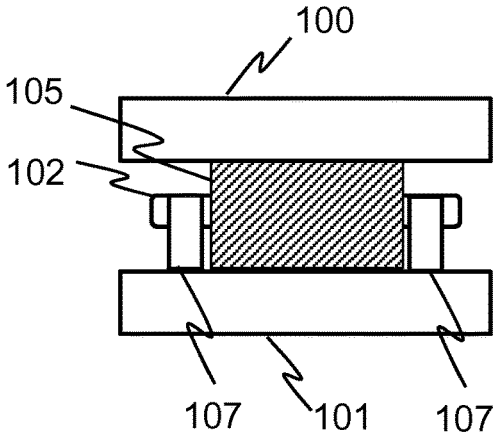
FIG. 3B shows a side view of a package according to an example embodiment of the invention.

FIG. 3B shows a schematic side view of a package according to an example embodiment of the invention seen from the direction of arrow A in FIG. 3A. FIG. 3B illustrates an arrangement of the films 105 and 107 of FIG. 3A according to an example embodiment of the invention. The film 105 connects the product 102 to the inner part 101 through the outer part 100, films 107 connect the product 102 to the inner part 101. The film 105 is arranged in the middle of the product 102 and the films 107 are arranged on both sides of the film 105. It can be seen that the films 105 and 107 are arranged so that they do not cross each other and in this way they can function without disturbing each other. It is noted that FIG. 3B shows just an illustrative example and that the films or ribbons of embodiment so of the invention can be arranged also in some other suitable manner. For example, the pull-out film 105 could be split into two pieces of films and a third piece of push-in film 107 could be placed between the two pieces of pull-out films 105.

Figure 4:
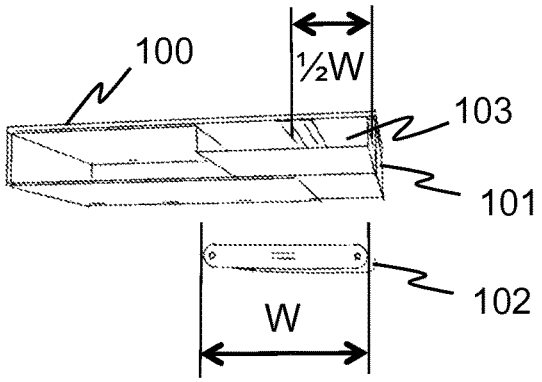
FIG. 4 illustrates some dimensions of a package according to an example embodiment of the invention.

FIG. 4 illustrates dimensions of a package according to an example embodiment of the invention. In this example, the package is designed for a product whose width is W. The package comprises a compartment 103 that is configured to receive the product with width W. In an example the dimensions of the compartment 103 are defined to match dimensions of the product. Now, in an example embodiment, the openings 108 and 109 in the outer part 100 through which the film 105 is configured to slide are placed at a position whose distance from an outer edge of the outer part 100 is ½ W. In an example embodiment the lengths of the films 105 and 107 in FIG. 3A are as follows: the active or operative length of the film 105 is 2 W+K and the active or operative length of the film 107 is W+L. The active or operative length herein refers to the length of the film when attached to the package, that is, the length of the film in operation. Before attaching the film, the length can be longer in order to allow suitable attachment to the package. K and L are correction factors configured to increase the length of the films to cover e.g. that the films need to go around the product and through the openings 108 and 109. Exact number of K and L may depend e.g. on thickness of the product, the amount of film needed to go through the openings 108 and 109, and/or some other factors. The factors K and L can be equal or they may have different values.

Figure 5:
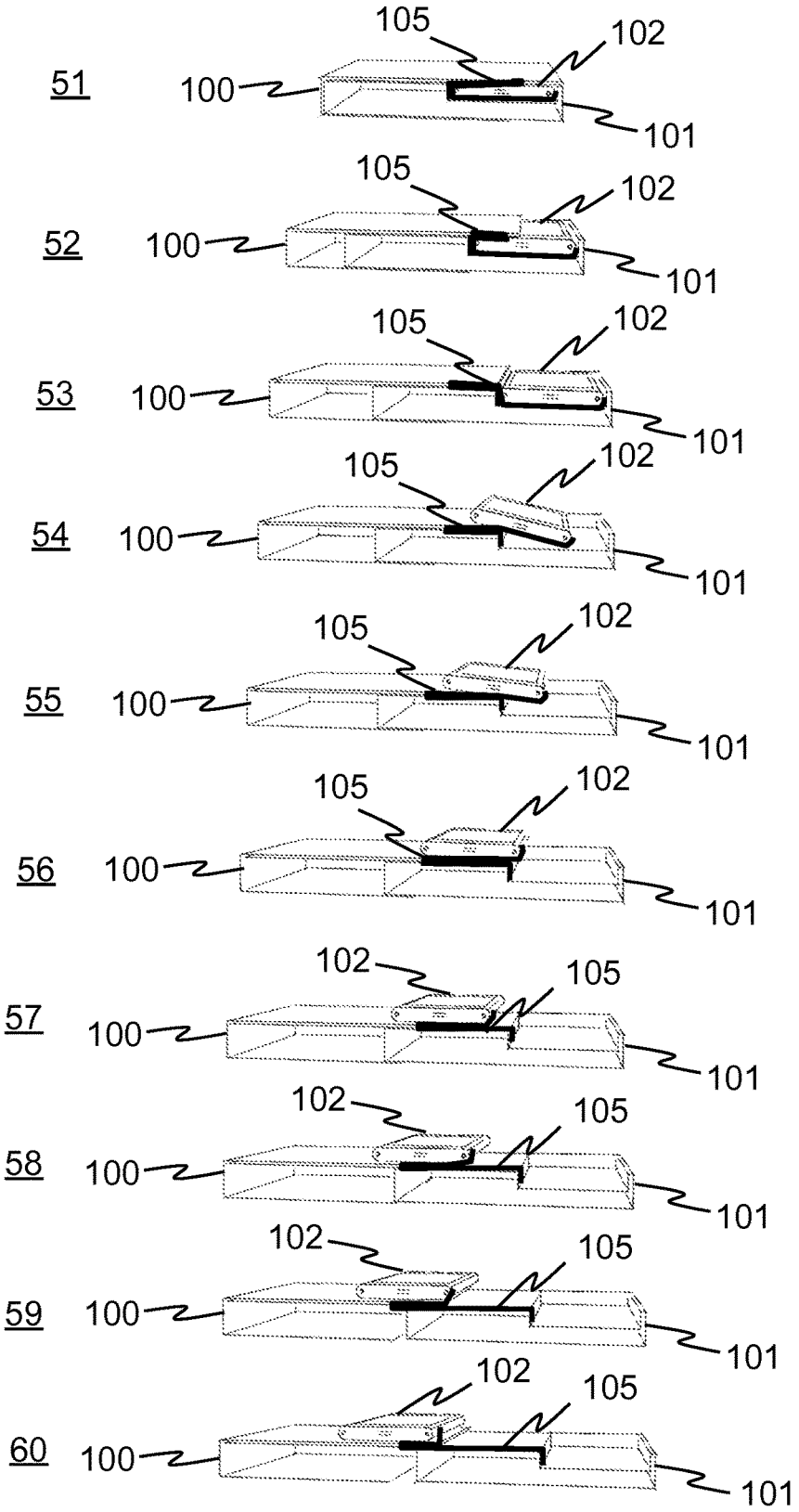
FIG. 5 shows a series of cross-sectional side views of a package according to an example embodiment of the invention in different stages during opening of the package.

FIG. 5 shows a series of cross-sectional side views of a package according to an example embodiment of the invention in different stages 51-60 during opening of the package.

The package comprises an outer part 100 and an inner part 101 that are configured to move in relation to each other. A product 102 is stored inside the package and the package comprises a pull-out film 105 configured to move the product (or a package component comprising the product) upon a user opening the package.

In stage 51, the package is in a closed configuration and the outer part 100 covers the inner part 101. In stages 52-60 the package is gradually opened and a product 102 inside the package becomes visible and the product 102 is pulled out of the package.

In stages 52 and 53, the pull-out film 105 starts with plenty of slack and the product 102 rests still inside the package.

In stages 54-59, the pull-out film 105 has no slack and the pull-out film starts to pull the product 102 out of the package to a surface of the package.

In stage 60, the package is in an open configuration and the product 102 rests on an outer surface of the package.

Figure 6:
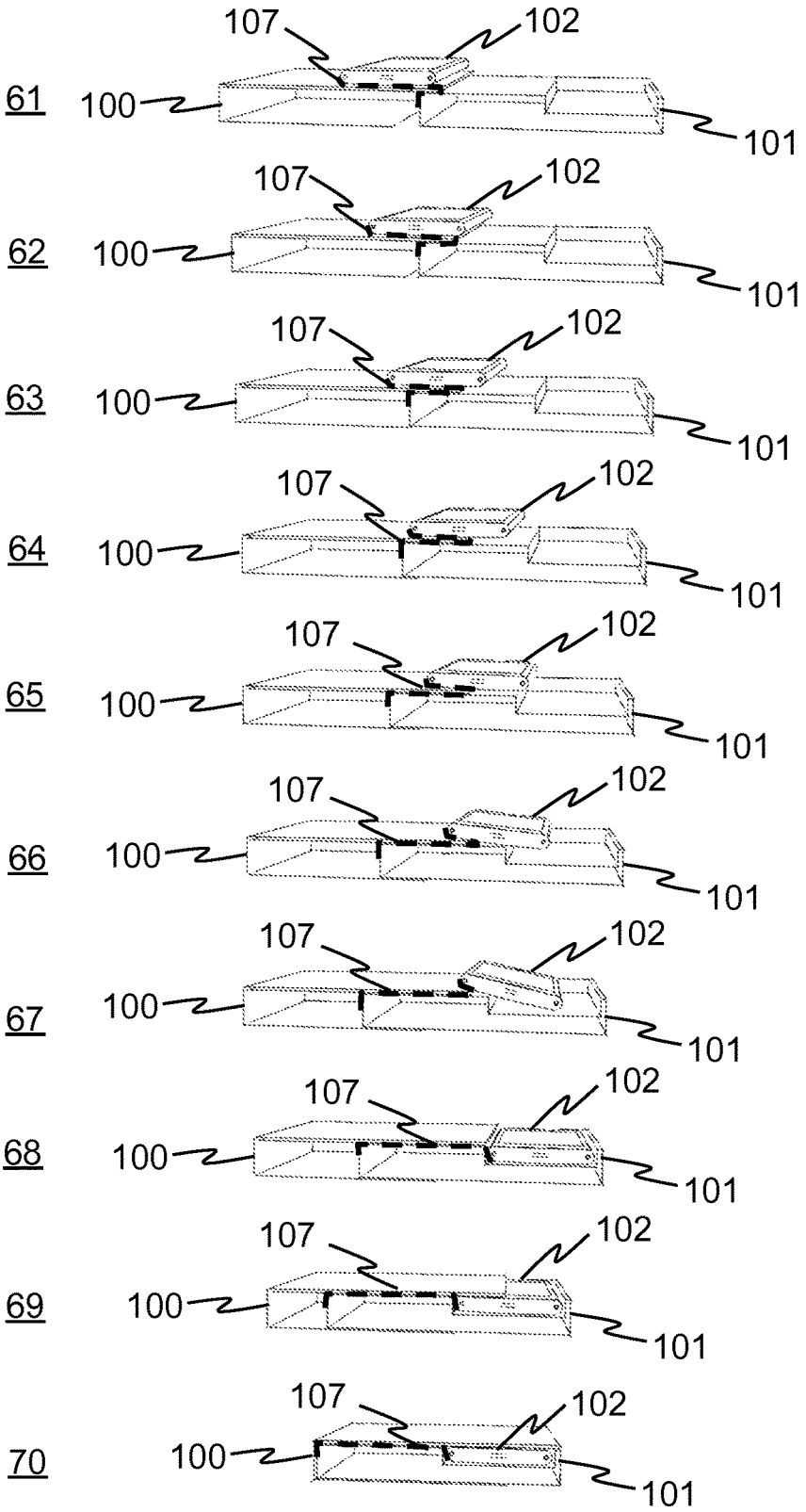
FIG. 6 shows a series of cross-sectional side views of a package according to an example embodiment of the invention in different stages during closing the package.

FIG. 6 shows a series of cross-sectional side views of a package according to an example embodiment of the invention in different stages 61-70 during closing the package.

The package comprises an outer part 100 and an inner part 101 that are configured to move in relation to each other. A product 102 is stored inside the package and the package comprises a push-in film 107 configured to move the product (or a package component comprising the product) upon a user closing the package.

In stage 61, the package is in open configuration and the product 102 resides on an outer surface of the package. The push-in film 107 starts with no slack. In stages 62-70 the package is gradually closed and the product 102 is pushed inside the package.

In stages 62-67, the push-in film 107 has no slack and as the outer part is moved towards the closed configuration, the push-in film 107 pushes the product 102 inside the package.

In stages 68-70, the product 102 rests still inside the package and the outer part 100 moves to cover the inner part 101 and the product 102.

In stage 70, the package is in a closed configuration and the outer part 100 covers the inner part 101.

Figure 7:
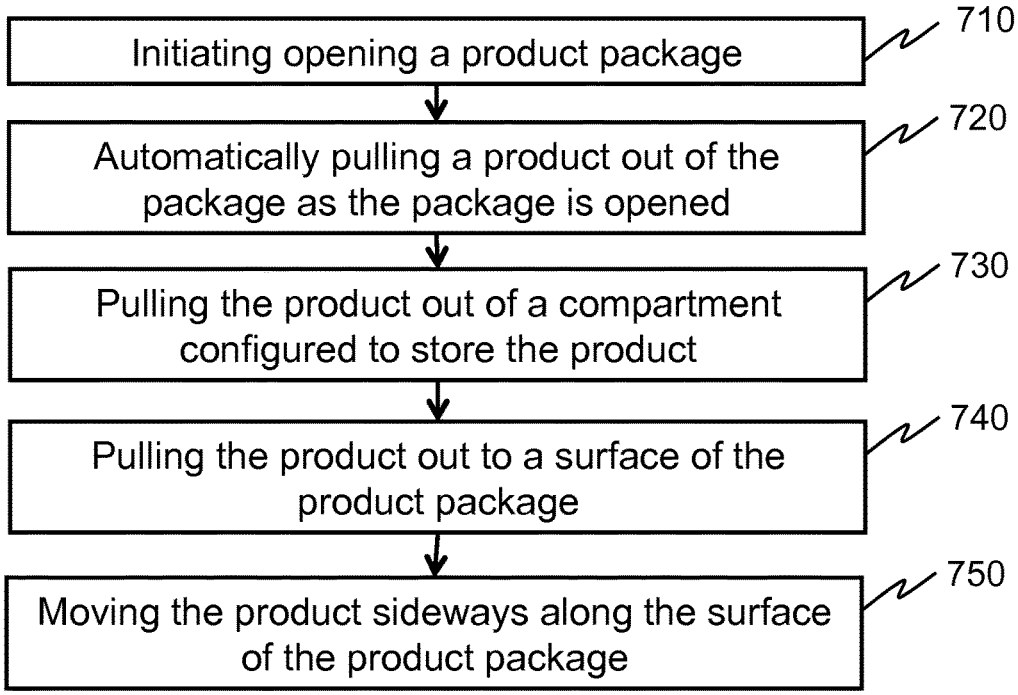
FIG. 7 shows a flow diagram illustrating a method according to an example embodiment of the invention.

FIG. 7 shows a flow diagram illustrating a method according to an example embodiment of the invention. The method may be performed for example in the package of previous Figures.

In phase 710 of the method, opening the product package is initiated. The product package comprises a product.

In phase 720, the product is pulled out of the package as the package is opened.

In phase 730, the product is pulled out of a compartment that is configured to store the product inside the package.

In phase 740, the product is pulled to a surface of the package. The product is pulled for example to top surface of the package.

In phase 750, the product is moved sideways along the surface of the package. In an example embodiment the product has a width W and the movement of the product is caused by a sideways opening movement of a package part. In the start of the opening movement the product remains stationary until the package is opened the length of W. When the package is opened another length of W, the product is caused to move the length 2*W compared to the opening movement.

Figure 8:
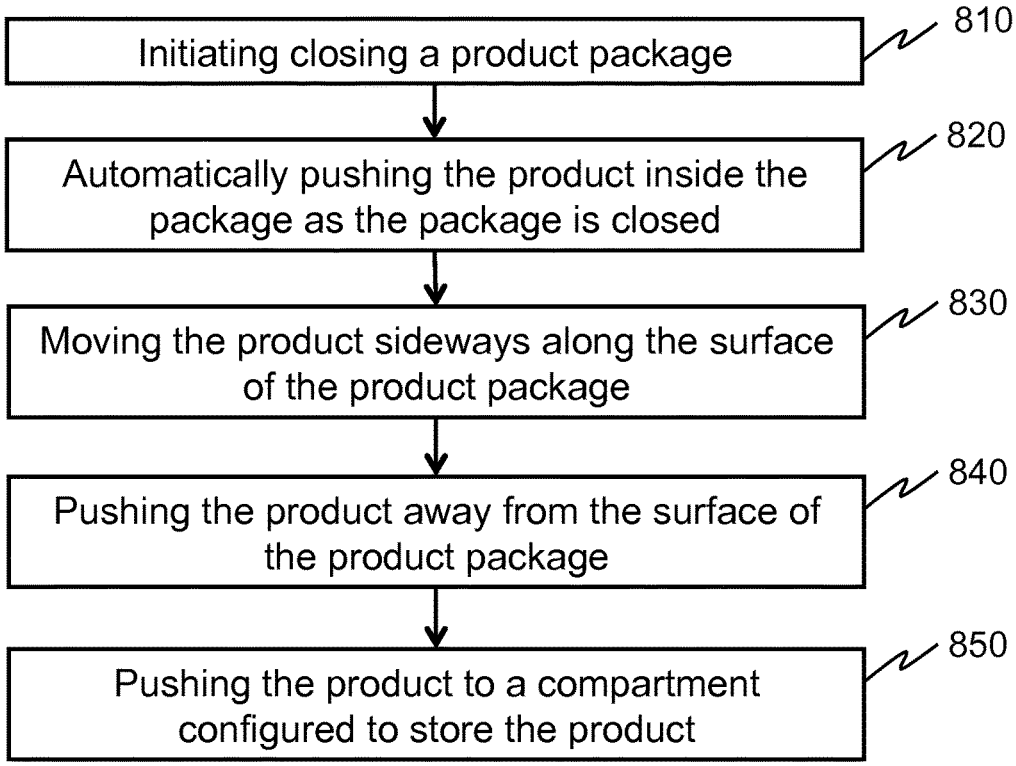
FIG. 8 shows a flow diagram illustrating a method according to an example embodiment of the invention.

FIG. 8 shows a flow diagram illustrating a method according to an example embodiment of the invention. The method may be performed for example in the package of previous Figures.

In phase 810 of the method, closing the product package is initiated. The package is in an open configuration and a product rests on a surface of the package.

In phase 820, the product is pushed inside the package as the package is closed.

In phase 830, the product is moved sideways along the surface of the package. In an example embodiment the product has a width W and the movement of the product is caused by a sideways closing movement of a package part. In the start of the closing movement, the closing package part moves a length W and the product is caused to move the length 2*W compared to the closing movement. Thereafter the product remains stationary as the closing package part moves another length W to fully close the package.

In phase 840, the product is pushed away from the surface of the package.

In phase 850, the product is pushed into a compartment that is configured to store the product inside the package.

Figure 9:
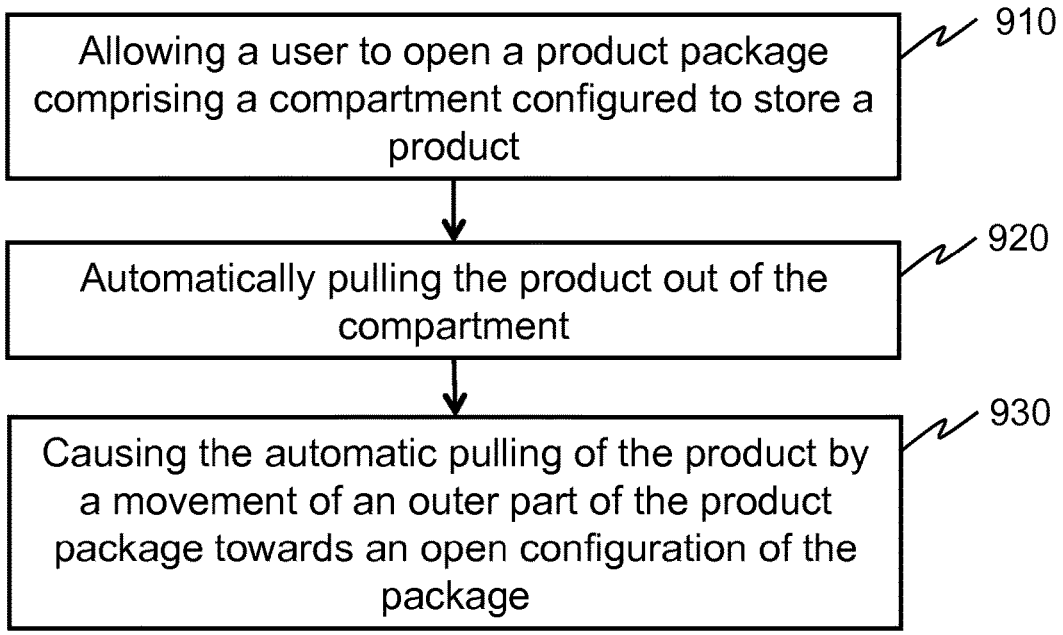
FIG. 9 shows a flow diagram illustrating a method according to an example embodiment of the invention.

FIG. 9 shows a flow diagram illustrating a method according to an example embodiment of the invention. The method may be performed for example in the package of previous Figures.

In phase 910 of the method, a user is allowed to open a product package. The product package comprises a compartment configured to store a product.

In phase 920, the product is automatically pulled out of the compartment.

In phase 930, the automatic pulling of the product is caused by a movement of an outer part of the product package towards an open configuration of the package. In an embodiment, at a later stage, movement of the outer part towards a closed configuration causes that a product residing on a surface of the package is pushed back inside the package.

A skilled person understands that within the scope of appended claims there are various package structures that enable the pull-out and/or the push-in effect in phases 720-750 and 820-850. Some example structures have been discussed in detail in preceding disclosure. Some further alternatives are discussed in the following.

Various example embodiments are disclosed in connection with a solution that comprises a sideways sliding outer part and combination of a pull-out and push-in films, but the invention is not limited to such examples only. The parts of the package that move to open the package can have different form or can move in some other manner in relation to each other, too. For example, in an embodiment the part that is moved to open the package is a lid instead of a sleeve like part. Furthermore it is not mandatory that the outer part fully covers the product in the closed configuration. The product can be covered partially or not covered at all. Still further, the product is not necessarily pulled to the top surface of the package, but to some other surface. As an alternative to a sideways movement of the package parts, the part that is moved to open the package can be turned about a hinge. In addition to the pull-out and push-in films, the pull-out and the push-in actions can be effected with some other structure, too. In examples shown in Figs. the product is pulled to the left as the package is opened. It is understood that other directions are also possible, the product can be pulled e.g. to the right or downwards.

Furthermore it is noted that various examples disclose both pulling out and pushing in effect, but also solutions comprising only either one of these are possible. Additionally it is noted that the pull-out and push-in mechanisms are not necessarily separate components, but can be formed of one movement member providing both pull-out and push-in functionalities.

Giving the consumer a surprise when unboxing a product is something to strive for and a package of various embodiments of the invention provides such surprise effect by automatically bringing the product out of the package upon opening the package. Without in any way limiting the scope, interpretation, or application of the claims appearing below, a technical effect of one or more of the example embodiments disclosed herein is thereby an improved opening experience. Another technical effect of one or more of the example embodiments disclosed herein is improved first impression for a product as opening a package containing the product appears magical to the users. Yet another technical effect of one or more of the example embodiments disclosed herein is an eye-catching packaging that positively surprises the consumer. In an example embodiment the product that is revealed is part of the packaging graphics. In an example, there is a picture of a hand in the package and when the package is opened, the product inside the package jumps into the hand.

Another technical effect of one or more of the example embodiments disclosed herein is that taking a product out of a package is made easy for a user. For example grabbing the product is easy as the product is fully exposed once the package is opened. Yet another technical effect of one or more of the example embodiments disclosed herein is that all contents of a package are revealed upon opening the package.

If desired, the different functions or process phases discussed herein may be performed in a different order and/or concurrently with each other. Furthermore, if desired, one or more of the above-described functions may be optional or may be combined.

It is noted that the Figures show some example industrial design(s). The shown examples represent one or many possible configurations and a multitude of other aesthetic configurations can be used in embodiments of the invention.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

The invention claimed is:

1. A product package comprising:

an inner part and an outer part, the outer part being configured to move in relation to the inner part between an open configuration and a closed configuration; wherein the inner part comprises a compartment configured to store a product; and wherein the package further comprises an opening mechanism configured to automatically pull the product out of the compartment of the inner part to an outer surface of the package and to slide the product along the outer surface of the package upon opening the package.

2. A product package according to claim 1, wherein, upon opening the package, a movement of the outer part towards the open configuration is configured to cause the opening mechanism to automatically pull the product out of the compartment of the inner part.

3. A product package according to claim 1, wherein the outer surface of the package is a top outer surface of the package.

4. A product package according to claim 1, wherein the opening mechanism is configured to pull the product out of the compartment of the inner part in a vertical direction and to slide the product along the outer surface of the product package in a horizontal direction upon opening the package.

5. A product package according to claim 1, wherein the opening mechanism comprises at least one elongated opening member.

6. A product package according to claim 5, wherein the elongated opening member is loosely engaged with the outer part so that the outer part is allowed to slide in relation to the elongated opening member and wherein one end of the elongated opening member is connected to the inner part and another end of the elongated opening member is operatively connected to the product.

7. A product package according to claim 6, wherein the elongated opening member is connected to the product through a packaging component configured to receive the product.

8. A product package according to claim 7, wherein the packaging component comprises at least one of the following: a cradle, a box, an insert, a protective plastic bag, a protective film, and a tray.

9. A product package according to claim 6, wherein a product configured to be stored in the package has a width W and the elongated opening member is engaged with the outer part at a position whose distance from an outer edge of the outer part is ½W.

10. A product package according to claim 1, further comprising a closing mechanism configured to automatically push the product into the compartment of the inner part upon closing the package.

11. A product package according to claim 10, wherein, upon closing the package, a movement of the outer part towards the closed configuration is configured to cause the closing mechanism to automatically push the product into the compartment of the inner part.

12. A product package according to claim 10, wherein the closing mechanism comprises at least one elongated closing member.

13. A product package according to claim 12, wherein one end of the elongated closing member is connected to the inner part and another end of the elongated closing member is operatively connected to the product.

14. A method comprising allowing a user to open a product package that comprises an inner part and an outer part configured to move in relation to each other between an open configuration and a closed configuration, wherein the inner part comprises a compartment configured to store a product; and upon the user opening the product package, automatically pulling the product out of the compartment of the inner part to an outer surface of the package and sliding the product along the outer surface of the package.

15. A method according to claim 14, further comprising causing the automatic pulling of the product by a movement of the outer part towards the open configuration.

16. A method according to claim 14, further comprising automatically pushing the product into the compartment of the inner part upon the user closing the package.

17. A method according to claim 16, further comprising causing the automatic pushing of the product by a movement of the outer part towards the closed configuration.

18. A method according to claim 16, further comprising automatically pushing a product residing on an outer surface of the package into the compartment of the inner part upon the user closing the package.

* * * * *